United States Patent [19]

Gewirtz et al.

[11] Patent Number: 5,034,067

[45] Date of Patent: Jul. 23, 1991

[54] PROCESS AND APPARATUS FOR KOSHERING CONTAINERS

[75] Inventors: Jonah Gewirtz, Silver Spring, Md.; Howard Skolnik, Chicago, Ill.; Paul R. Dukes, Maunee, Ohio

[73] Assignee: Skolnik Industries, Inc., Chicago, Ill.

[21] Appl. No.: 550,298

[22] Filed: Jul. 9, 1990

Related U.S. Application Data

[63] Continuation-in-part of Ser. No. 348,803, Aug. 8, 1988, Pat. No. 5,026,431, which is a continuation-in-part of Ser. No. 131,291, Dec. 8, 1987, Pat. No. 4,830,675, which is a continuation of Ser. No. 872,016, Jun. 9, 1986, abandoned.

[51] Int. Cl.[5] ..... B08B 7/00

[52] U.S. Cl. ..... 134/41; 134/2; 134/3; 134/30; 134/40; 252/118; 110/236; 432/2; 432/59; 432/75; 432/124; 432/224

[58] Field of Search ..... 134/2, 3, 40, 36, 41, 134/20; 252/118; 432/2, 59, 75, 124, 224; 110/236

[56] References Cited

U.S. PATENT DOCUMENTS

| | | | |
|---|---|---|---|
| 284,016 | 8/1883 | Hynson | 432/224 |
| 422,496 | 3/1890 | Sherman | 432/224 |
| 433,876 | 8/1890 | Oncken | 432/224 |
| 954,623 | 4/1910 | Grahm | 432/224 |
| 1,052,512 | 2/1913 | Phillips | 432/224 |
| 1,125,930 | 1/1915 | Arnemann | 432/224 |
| 2,194,433 | 3/1940 | Schorek | 432/224 |
| 2,294,168 | 8/1942 | Francis et al. | 432/224 |
| 3,050,297 | 8/1962 | Walter | 432/224 |
| 4,830,675 | 5/1989 | Skolnik | 134/3 |
| 4,906,301 | 3/1990 | Skolnik | 134/3 |

*Primary Examiner*—Asok Pal

*Attorney, Agent, or Firm*—Milton S. Gerstein; Marvin Benn

[57] ABSTRACT

An oven-apparatus for flaming the interior and exterior surfaces of a container for removing nonkosher oils, fats, dirt, and the like, which apparatus has a main housing defining a tunnel through which are conveyed containers to be flame-treated, and a first flame-burner capable of developing a substantially vertically-oriented exposed flame for flame-treating the interior surface of a container, and a second flame-burner capable of developing a horizontally-oriented flame for flame-treating the exterior surface of a container. The apparatus also has a conveyor for conveying a plurality of containers to be flame-treated adjacent to the first and second flame-burners. A turntable lifts and rotates the container while the two flame-burners' flames treat all of the surfaces of the container.

28 Claims, 8 Drawing Sheets

PROCESS AND APPARATUS FOR KOSHERING CONTAINERS

CROSS-REFERENCE TO RELATED APPLICATION

This is a continuation-in-part application of application Ser. No. 07/348,803, filed May 8, 1988, now allowed, U.S. Pat. No. 5,026,431, which is a continuation-in-part of application Ser. No. 07/131,291 filed Dec. 8, 1987, now U.S. Pat. No. 4,830,675, which is again a continuation of application Ser. No. 06/872,016 filed June 9, 1986, now abandoned.

BACKGROUND OF THE INVENTION

The present invention relates generally to the processing of manufactured metallic containers and, more particularly, to a process whereby metallic storage containers are processed to allow foods prepared in accordance with the dietary laws of koshering to be stored and transported while retaining the kosher integrity of the food.

The strict dietary laws by which it is determined that foods are kosher require total abstinence from certain foods, prohibit the mixing of certain types of food on a single plate or at a single meal, and also prescribe the manner in which an animal, in order to be considered kosher, must be raised, butchered, and cooked. For example, according to Mosaic Law, certain foods such as pork products and shrimp are inherently not kosher and cannot be prepared to render them kosher. It is also a requirement of the dietary laws that meat dishes and dairy dishes cannot be consumed together, so that otherwise kosher foods, if improperly combined in a single meal will render the meal non-kosher even though the individual components themselves are prepared according to the laws of kosher.

When a vessel, such as a cooking pot, is used to prepare a meat dish, and must thereafter be used to prepare a dairy dish, the vessel must be cleaned thoroughly enough to remove all vestiges of the previously prepared meat dish, such as by the use of boiling water, steam, or flame drying. To my knowledge, there has been no practical method developed to date to adapt such a koshering process to large-volume containers, such as 55 gallon drums. If, for example, the food to be stored is "dairy" in nature, the presence of any contaminant traceable back to a "meat" origin may destroy the kosher character of the food. In like fashion, any "non-kosher" contaminant may also produce the same result.

Problems can then arise when, after food has been prepared in a kosher manner, it is stored in such a way that the storage vessel becomes a vehicle for contaminants which, while not adulterating the food in a medically harmful sense may still contribute contaminants of a character sufficient to destroy the kosher integrity of the food.

As an example, certain metallic containers, such as cans or drums used for the bulk storage and transportation of foods may, during the manufacturing process, may come in contact with, and be coated with a thin film of oil or grease, the presence of which in an otherwise kosher food may destroy the integrity of the koshering process.

Foods prepared in accordance with the dietary laws are certified as kosher by one trained to observe the entire manufacturing process and determine whether the method of preparing the food and the individual ingredients are consistent with the practice and observance of the dietary laws. In much the same manner, the same determination must be made with respect to the preparation of packaging for the food so prepared.

U.S. Pat. Nos. 4,830,675 and 4,906,301—Skolnik, which patents are incorporated by reference herein, disclose a method for achieving the koshering of the above-mentioned drums, in which the surfaces of the drums are subjected to flame-treatment for burning off any residue of oils, fats, and the like.

In copending application Ser. No. 07/348,803, filed on May 8, 1989, there is disclosed an oven by which the flame-treating step disclosed and claimed in the above-mentioned commonly-owned patents may be carried out. The present invention is directed to another oven-apparatus for performing the flame-treatment of the drums for koshering purposes.

SUMMARY OF THE INVENTION

It is the primary objective of the present invention to provide an oven-apparatus by which the flame-treatment of drums is carried out in a manner that ensures the koshering of the drums.

It is another objective of the present invention to provide such a flame-treating oven-apparatus that flame-treats a series of drums transported therethrough via a conveyer system.

It is another objective of the present invention to provide such a drum that is substantially automatic in operation.

BRIEF DESCRIPTION OF THE DRAWINGS

The invention will be more readily understood with reference to the accompanying drawing, wherein.

DETAILED DESCRIPTION OF THE INVENTION

While use of the oven-apparatus of the invention disclosed herein may be extended to containers of varying sizes and configurations, a preferred use of the presently-described oven-apparatus is directed primarily to relatively large containers, such as steel drums having a capacity of about 55 gallons. Such drums are typically cylindrical in shape and have lids which may be either strapped, crimped, or otherwise attached to close off the drum. Access to the drum may thereafter be had by removing the lid, or through a hole or port formed in the lid.

A preferred embodiment of the present invention features the movement of a metallic drum, intended to be rendered fit for the storage and transportation of kosher foods past various processing stations, utilizing well-known techniques of material handling and transportation, such as conveyor belts and the like. The individual stations involved in the process are each specially modified to accommodate the operation carried out at each station and the material being applied to the drum at each station. The oven-apparatus of the invention is specifically directed to the step of flame-treating a drum, which may be the fourth step in the overall process of koshering a drum, as set forth in the U.S. Pat. Nos. 4,830,675 and 4,906,301—Skolnik. It is also, of course, possible that flame-treatment carried out by the oven-apparatus of the present invention is substantially the only step performed in koshering a container.

The drums or containers to be flame-treated by the oven-apparatus of the invention are generally hollow containers, without a bottom or top cover lid having been placed thereon. The bottom and tops lids are themselves subject to flame-treatment by another drum-lid oven-apparatus disclosed in commonly-owned, copending application Ser. No. 564,094, filed on 08/08/1990. After the main, cylindrical drum-body and lid have been flame-treated, the bottom lid is placed on the drum body, in the conventional manner, with the upper lid's placement being performed after the drum has been filled with the desired contents.

Figure 1:
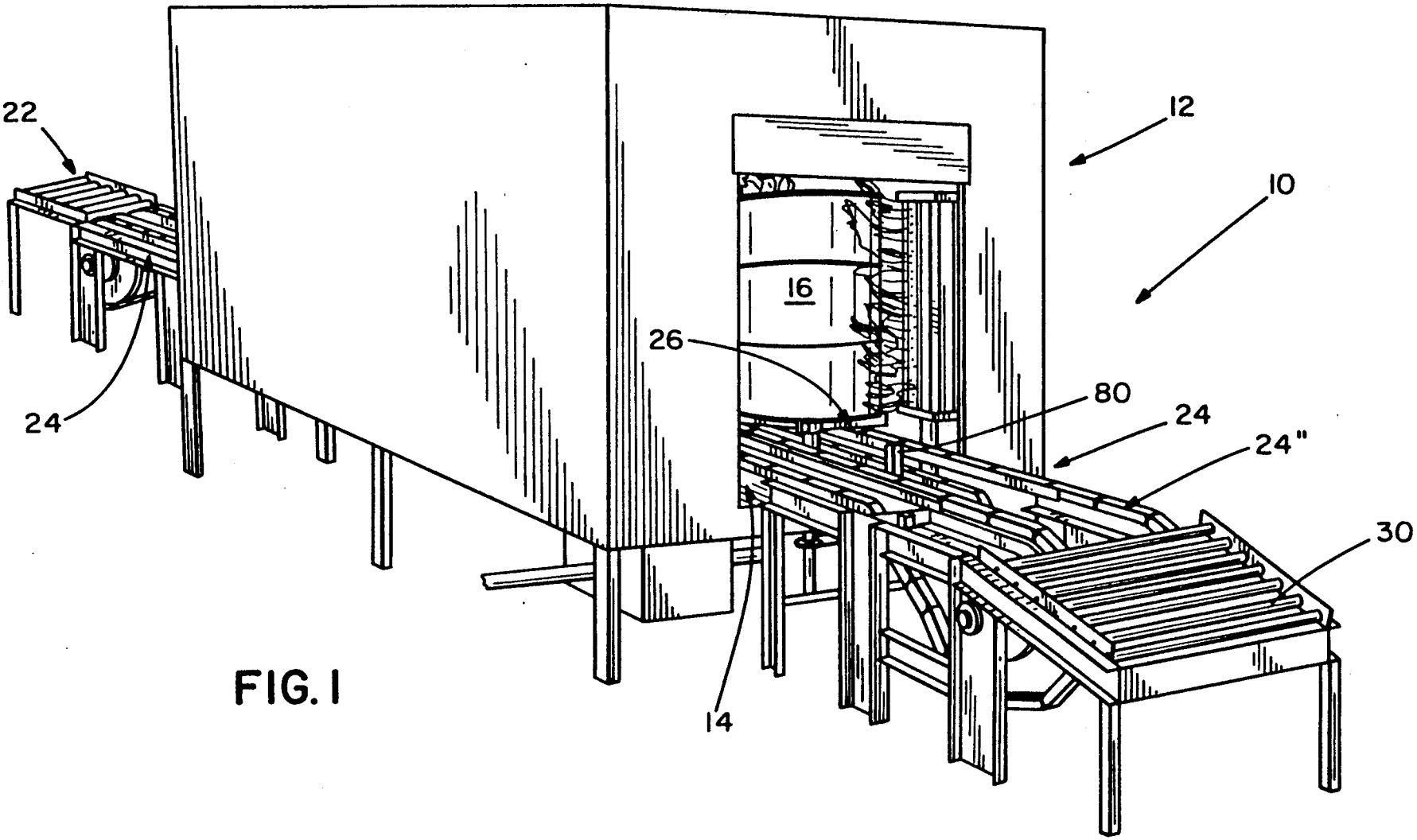
FIG. 1 is an isometric view of the oven-apparatus of the invention for carrying out the flame-treatment of containers.
Figure 2:
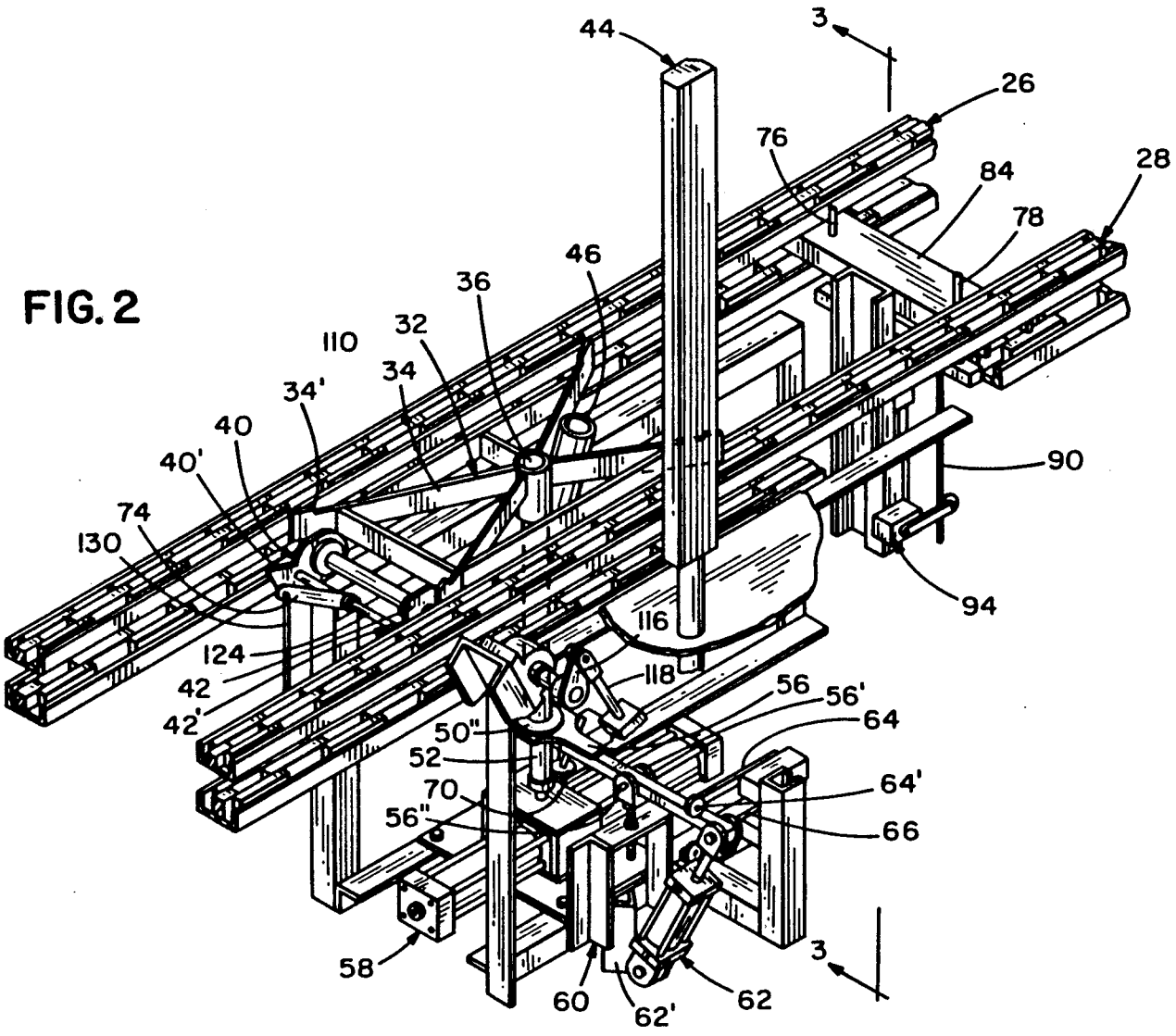
FIG. 2 is an isometric view showing the forward portion of the oven-apparatus where each container is stopped, lifted up, rotated, and flame-treated according to the invention, and showing the state of the oven-apparatus at the start of the cycle, where the drum-lifting platform or turntable is in its lowered position, and the rear stops are also in their in lowered position.

Referring to FIG. 1, there is shown the oven-apparatus 10 of the invention. The apparatus 10 includes a main housing 12 defining a pair of parallel side walls and an upper wall, all made of heat-insulating material, through which is formed a passageway or tunnel for the passage of drums or containers to be flame-treated. The main housing 12 also includes a lower or bottom support wall 14 which mounts a conveyer system for the transporting cylindrical-shaped drums or containers 16 through the main housing, this bottom wall also being appropriately cut out at portions thereof to accommodate the movement of various mechanisms of the invention, as set forth below in greater detail. Each drum is open at the top and bottom, the bottom lid therefor being formed therein at a later stage, which lid is also flame-treated in a different, distinct oven-apparatus. The conveyer system starts at the rear with horizontal rollers 22, which typically receive the drums 16 after the drums have exited a washing station (not shown), as set forth in U.S. Pat. Nos. 4,830,675 and 4,906,301. From the rollers 22, each drum enters onto the conveyer system of the oven-apparatus 10 proper, indicated generally by reference numeral 24. The conveyer system 24 extends from the rear of the main housing, with the rear section thereof indicated by 24', through the main housing 12, and out therefrom to define a front section 24''. The conveyer system 24 has a pair of conventional, parallel, continuously-driven conveyer chain-belts 26, 28, as seen in FIG. 2. The belts are made of a material that allows the drums to be held stationary while the belts are driven, when stops prevent the further movement of a drum along the conveyer, as explained below in greater detail. The forward section 24'' of the conveyer system also defines a declivitous drop-off portion 30 defining additional rollers for directing the flame-treated drum to another conveyer system for transporting each drum to a desired location, such as inventory-storage locations. The conveyer-belt assembly and the drive therefor are conventional.

Figure 3:
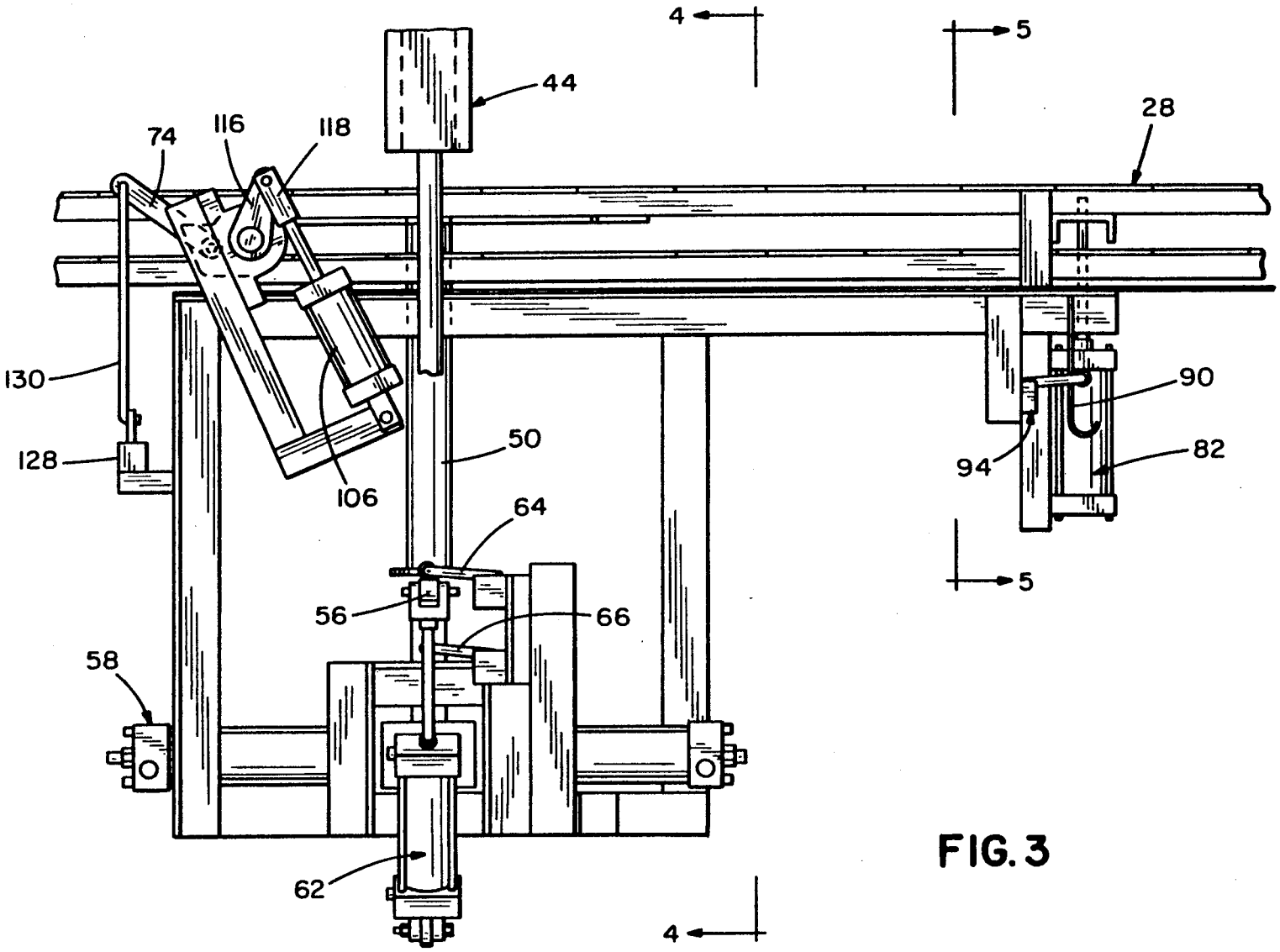
FIG. 3 is a side elevational view of the assembly of FIG. 2, as seen along the line 3—3 of FIG. 2.
Figure 4:
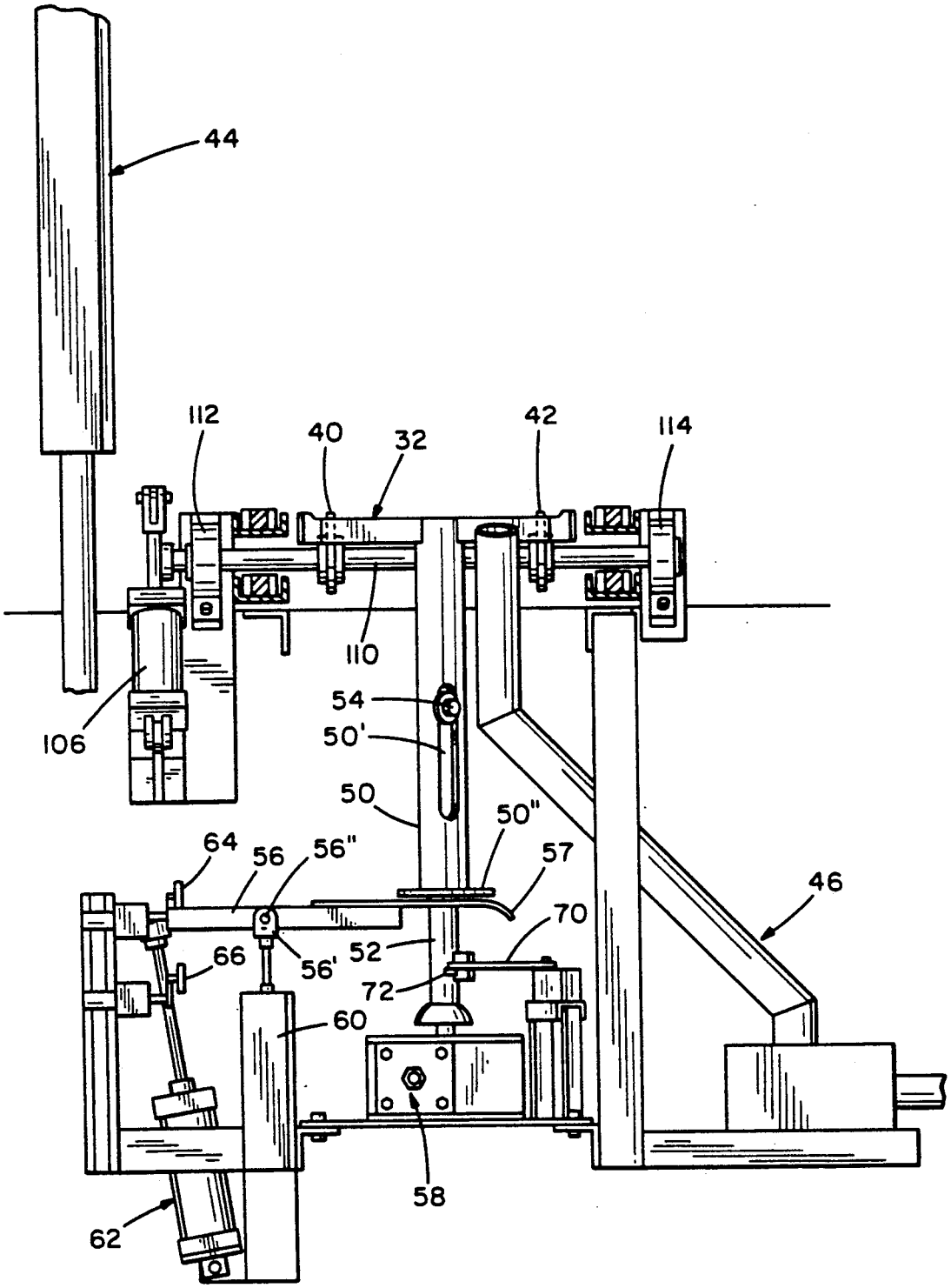
FIG. 4 is a cross-sectional view taken along line 4—4 of FIG. 3.

Referring to FIGS. 2–4, the forward portion of the main housing mounts, below the lower wall thereof, a vertically-movable, rotatable, drum-supporting platform or turntable 32, which platform or turntable is comprised of four splines 34 emanating from a common-center mounting sleeve 36. The distal, radial end of each spline 34 is formed to provide an abutment-surface 34' by which a drum 16 may be nestled on the platform or turntable and held safely thereon. The platform 32 is vertically movable in the empty space between the two chain-belts 26, 28, and is rotatable 360 degrees in either direction, with the directions of rotation alternating for successive drums, as set forth below. The platform or turntable 32 is positioned below the two conveyer-belts 26, 28 when in its lowered state, in order to allow for the unhindered movement of a drum being conveyed by the belts. The platform 32 is raised after a drum has been stationarily positioned directly thereover by means of retractable forward stops or clamps 40, 42, described below, in order to lift the drum off of the continuously-moving chain-belts 26, 28, in order to initiate the flame-treatment. The flame-treatment is carried out on all surfaces of the drum 16, with one gas-burner 44 providing the flames for flame-treating the exterior surface of each drum, and with one gas-burner 46 (seen in FIG. 8) providing the flames for flame-treating the interior surface of each drum. The gas-burner 44 flame-treats the exterior surface of a drum by the 360 degree rotation of the drum via the platform 32. The gas-burner 44 is mounted laterally-exteriorly of the chain-belt 28, as seen in FIG. 2, while the gas-burner 46 is mounted below the chain-belts 26, 28, with an exit nozzle 46' thereof projecting upwardly in close juxtaposition below the bottom of the chain-belts and in alignment with platform or turntable 32, so that the flames exiting the nozzle 46' extend upwardly into the hollow interior of a drum 16. Thus, it may be seen that for one complete rotation of the elevated platform or turntable 32, the entire interior and exterior of the drum is flame-treated. The gas-burner 46 is conventional, and may be that manufactured by Maxon Corp. of Munsey, Ind., model number "415 OVERPAK". This burner has an 8 inch circular barrel cone from which the flames project, so that such flames spiral outwardly therefrom into the hollow interior of the drum. The gas-burner 44 may be that manufactured by Eclipse Inc. of Rockford, Ill., model number 240AH. These gas-burners are flame-adjustable, whereby the heat produced and projections of the flames are adjustable, so that the heat applied and time-duration of the flame-drying method step may be suitably and accordingly varied. The oven-apparatus 10 is also provided with a conventional exhaust fan assembly. Each of the burners, as mentioned above, has an adjustable flame, with the range of temperatures of the flames from any one burner being between 600 degrees F. and 3000 degrees F. In the preferred embodiment, the length of flame-exposure of the hollow interior of the drum to the flames of the burner 46 is between two seconds for the upper range of temperature, and up to 30 seconds for the lower range thereof, it being understood that the flame-temperature and flame-exposure time is variable depending upon the size of the drum or container.

After the drum has been flame-treated by the 360 degree rotation of the platform or turntable 32, the platform or turntable is lowered to its lowered position below the horizontal plane of the chain-belts 26, 28, whereby, during its downward movement, such causes the lower circumferential lip of the drum to again be positioned on the continuously-moving chain-belts, so that the thus-treated drum may be carried out of the apparatus, and stored in inventory, or the like. The clamps or stops 40, 42 which had centered the drum above the lowered platform or turntable, are lowered or released when the platform or turntable has been centered and lifted by the platform or turntable, so as to allow for this re-entry of the treated drum back onto the conveyer system after flame-treatment, as explained below in greater detail.

Figure 8:
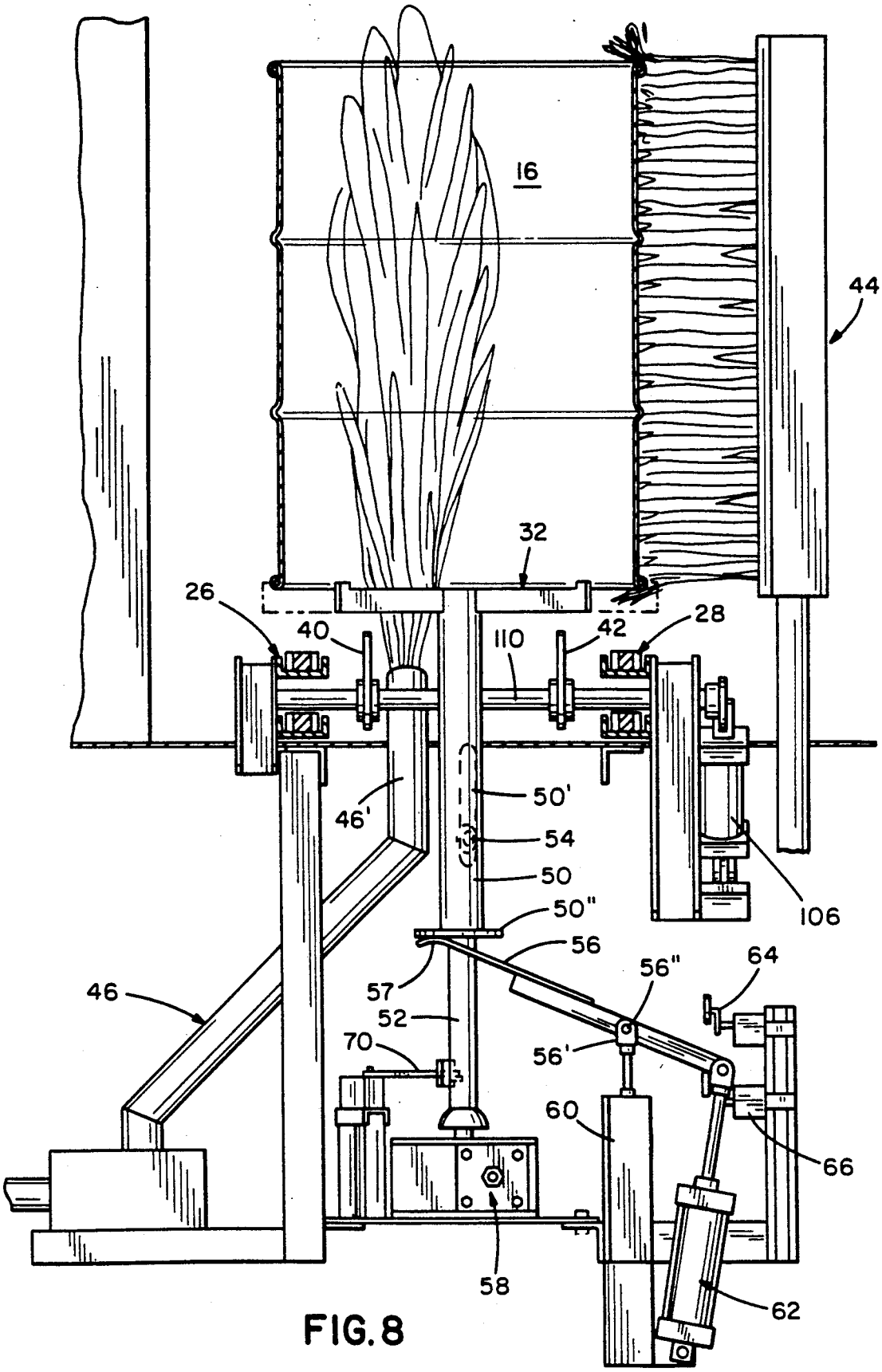
FIG. 8 is a front view of the stage of the oven-apparatus shown in FIG. 7, with the drum-lifting platform or turntable in its raised position, and showing the gas-burners for providing flames against the exterior surfaces of a drum be rotated by the platform or turntable and against the interior surface of the drum.

Referring to FIG. 8, the platform or turntable 32 is mounted at the upper end of a vertical, rotatable, hollow post 50 which telescopingly receives a rotatable drive-shaft 52, the upper end of which drive-shaft mounts a projecting drive-pin 54 projecting through, and slidable in, a vertical slot 50' formed in the post 50. When the drive-shaft 52 is rotated, the post 50 is concurrently rotated therewith. The lower end of the post 50 defines an enlarged flange 50'' by which the post may be slid upwardly in order to raise the platform or turntable 32, via a vertically-pivotal camming arm 56. The slot-pin connection 50', 54 provides the lostmotion coupling required. The drive-shaft 52 is driven by a conventional, pneumatic rotary actuator 58. The pivotal cam lever arm-member 56 is mounted for pivotal movement by pillow block 56' and journal 56'', via an upstanding U-shaped support 60. A pneumatic cylinder 62 is pivotally coupled to the distal end of the lever-arm 56, which pneumatic cylinder is also pivotally connected at its bottom to the support member 62' connected to the upstanding support 60, as clearly shown in FIG. 2. Upon actuation of the cylinder 62, the lever-arm 56 is rotated in one direction or the other in order to either raise or lower the platform or turntable 32 via the camming action between the arcuate end 57 of the lever-arm 56 and the enlarged flange 50'' of the vertical post 50. The upper and lower positions of the platform or turntable 32 are determined by a pair of vertically spaced-apart limit-switches, best seen in FIGS. 2 and 8, which limit-switches have associated therewith control-arms 64, 66. Each control arm mounts a roller 64', 66' for contact against a respective portion of the camming lever-arm 56, in the conventional manner, by which the pneumatic actuator is de-actuated to define the limits of the upper and lower positions of the platform or turntable 32, the control-arm 64 controlling the lower-limit position, and the control-arm 66 controlling the upper-limit position of the platform or turntable 32.

The platform 32 is rotatable in either the clockwise or counterclockwise directions, the directions of rotation alternating, so that one drum is rotated in the clockwise direction and the next drum rotated in the counterclockwise direction, via the reversible rotary actuator 58. Each rotation is for a full 360 degrees, to ensure that all of the outer, circumferential wall surface of the drum is exposed to the flames from the laterally-positioned gas-burner 44. The full 360 degree rotation is achieved via limit-switch control operated by a pivotal control arm 70 (shown in FIGS. 2, 4 and 8) which is pivoted in response to a cam member 72 provided on the rotating shaft 52, so that, after one complete rotation, the pneumatic actuator 58 is de-energized. The pneumatic actuator 58 is actuated by the tripping of a control lever 74 by the drum, which control lever 74 also causes the lowering of the forward clamps or stops 40, 42, described below in greater detail.

Figure 5:
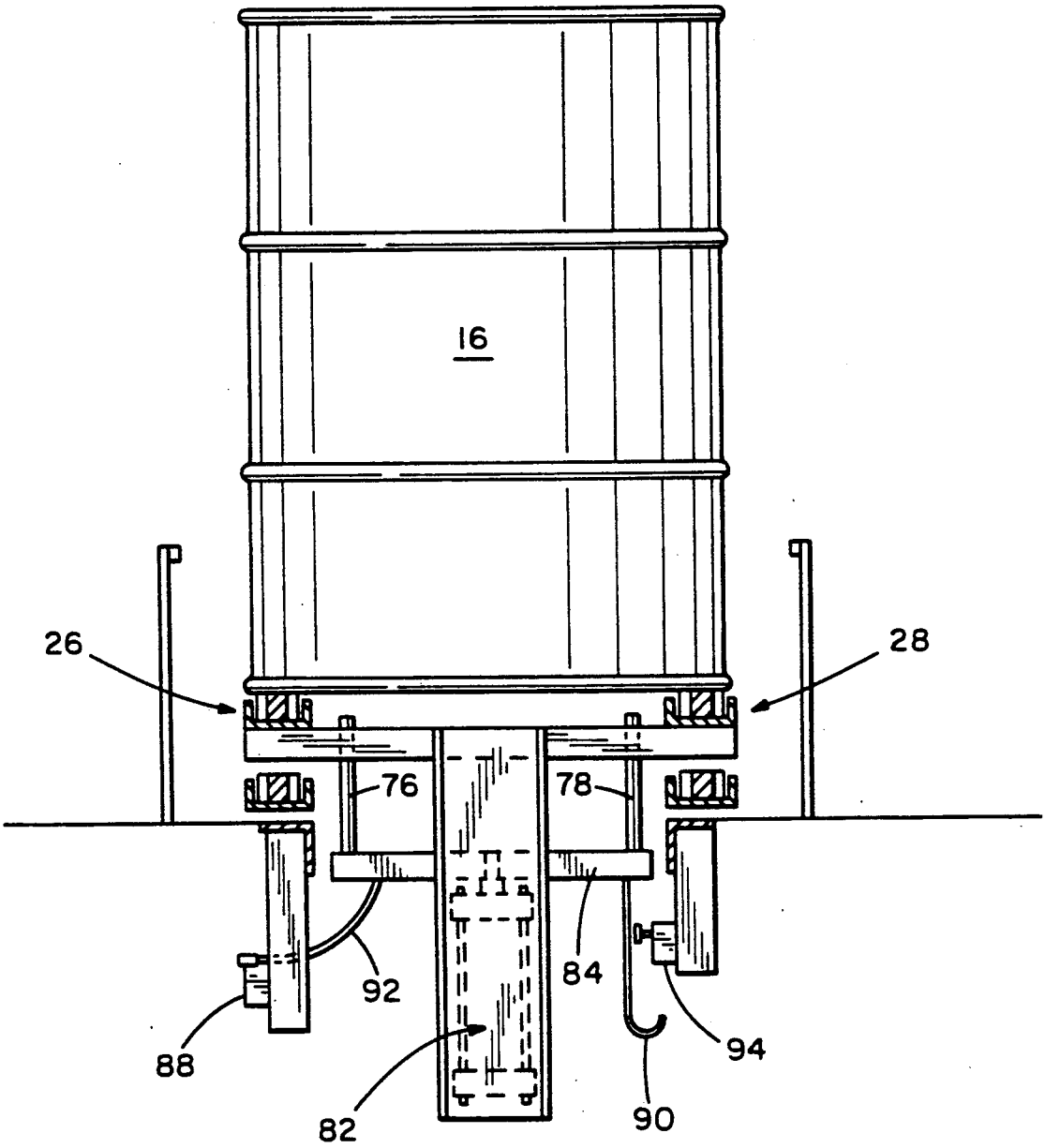
FIG. 5 is a cross-sectional view taken along line 5—5 of FIG. 3.

Rear clamps or limit pins 76, 78 are also provided in the rear of the main housing 12, at the entrance to the tunnel thereof. These rear stop-pins prevent further movement of the next drum into the tunnel until after the drum on the turntable 32 has been completely flame-treated, and has exited from the tunnel of the main housing. The rear stop-pins are lowered in response to the flame-treated drum's exit from the tunnel and the tripping of a lever switch 80 (FIG. 1) by that drum, which, thus, causes the actuation of a vertically-mounted pneumatic cylinder 82 (FIGS. 3 and 6), the piston rod of which mounts a mounting plate 84, which mounting plate 84 mounts the pair of rear-stop pins 76, 78 on the upper surface face thereof, as best seen in FIG. 2. The mounting plate 84 has a length traversing the entire width between the chain-belts, with the stop-pins 76,78 being spaced apart so as to project through the vacant space between the chain-belts on the laterally-interior side of each respective chain-belt 26, 28. The limit of the upper and lower movements of the mounting plate 84 and piston rod of pneumatic actuator 82 are controlled by actuator arms of limit-switches 88, 90 via contact arms 92, 94 (FIG. 5) extending downwardly from the lower or bottom surface face of the mounting plate 84. Contact arm 92 and limit-switch 88 limit the downward movement of the mounting plate 84 and associated pneumatic cylinder 82 by de-actuating the cylinder 82, while the contact arm 90 and limit-switch 94 limit the upward movement thereof by deactuating the cylinder 82. Actuation of the pneumatic cylinder 82 to lift the mounting plate 84 and the stop-pins 76, 78 to prevent further movement of the next drum to be flame-treated is achieved by an intermediate trip-lever switch arm 100 (FIG. 6), which arm 100 is tripped by the passage therepast of a drum being conveyed to a position above the turntable 32 for flame-treatment. This tripping of the arm 100 also causes the actuation of a cylinder 106 to cause the rotational movement of the forward clamps or stops 40, 42 to their raised position to stop the drum directly above the lowered or retracted turntable 32. The actuation of the pneumatic cylinder 82 to lower the mounting plate and the rear stops is achieved by the forward actuator arm 80, described above, in order to allow for the next drum to advance to a position above the turntable. Thus, there is ensured that a drum is not conveyed to the turntable 32 until after the drum already flame-treated has exited the oven-apparatus 10. Another switch-lever 100' is positioned a short distance downstream of the lever-arm 100, so that after the forward and rear stops have been raised, the drum will trip the switch-arm 100', which controls the gas-burners 44, 46, to cause the igniting thereof.

This ignition is achieved after a predetermined time-delay, to allow the drum time to reach the area above turntable 32 and be raised thereby, the flames from the gas-burners commencing after the turntable has lifted the drum to its fully-raised position, and just before the turntable rotates.

As mentioned above, the lever actuator-arm 74 (FIG. 2) is tripped by the advancing drum just before the drum is centered over the lowered or retracted turntable 32. When the drum trips the arm 74, two actuations occur: Firstly, the cylinder 106 is actuated to rotate the forward clamps 40, 42 into their lowered, retracted positions, and, secondly, the cylinder 62 is actuated to raise the platform 32 upwardly to lift the drum off of the conveyer belts, for subsequent rotation and flame-treatment, as described above. In order to ensure that the drum has been lifted off of the conveyer belts by the turntable before the forward clamps 40, 42 have been retracted, there is a short time delay before the cylinder 106 is actuated.

Figure 6:
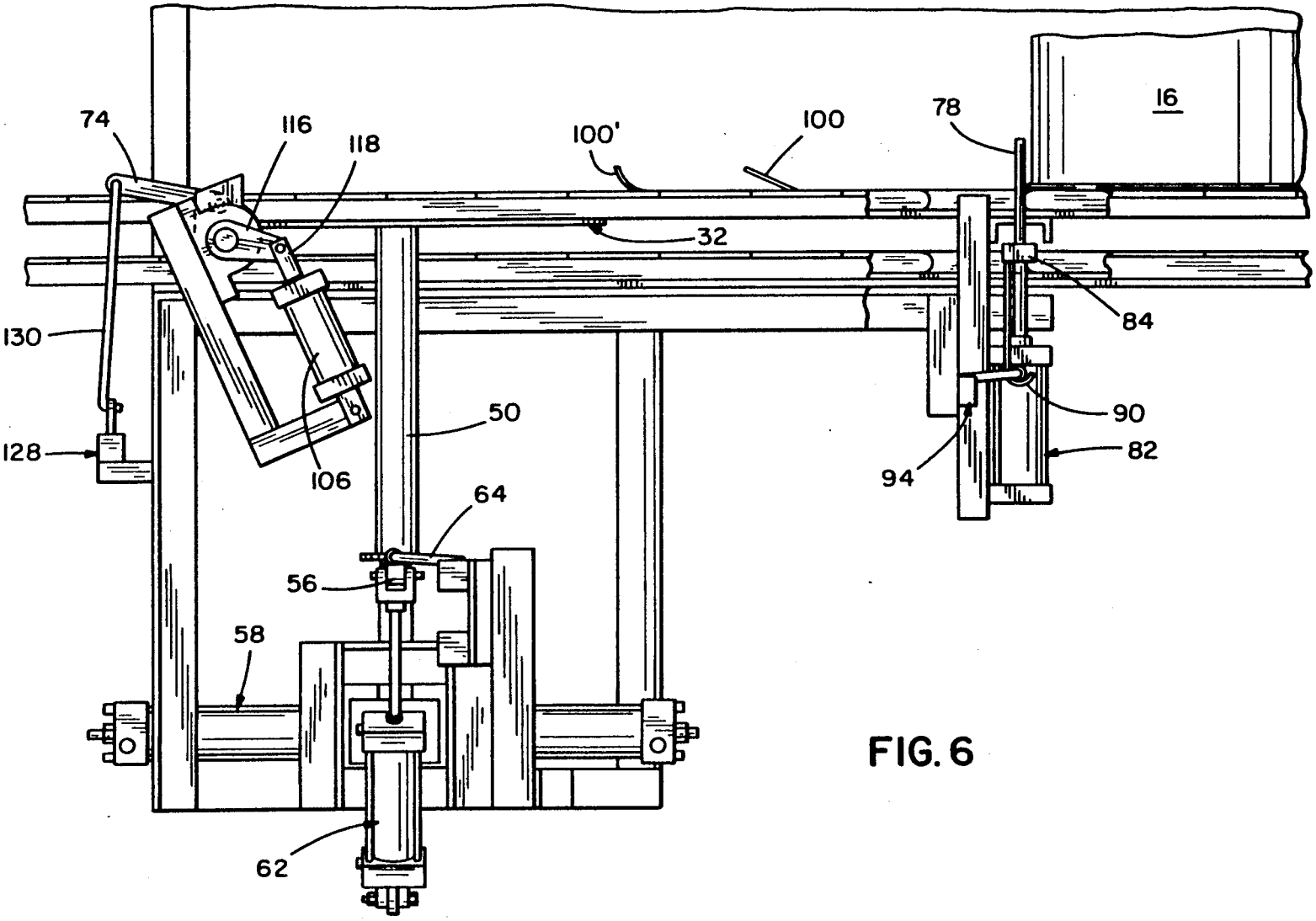
FIG. 6 is a side elevational view similar to that of FIG. 3, but showing the oven-apparatus in its next stage of operation, where both the front stops and rear stops are in their raised positions, for stopping the first drum at the drum-lifting platform or turntable, and for stopping the next drum to be treated before entry to the flame-burners.
Figure 7:
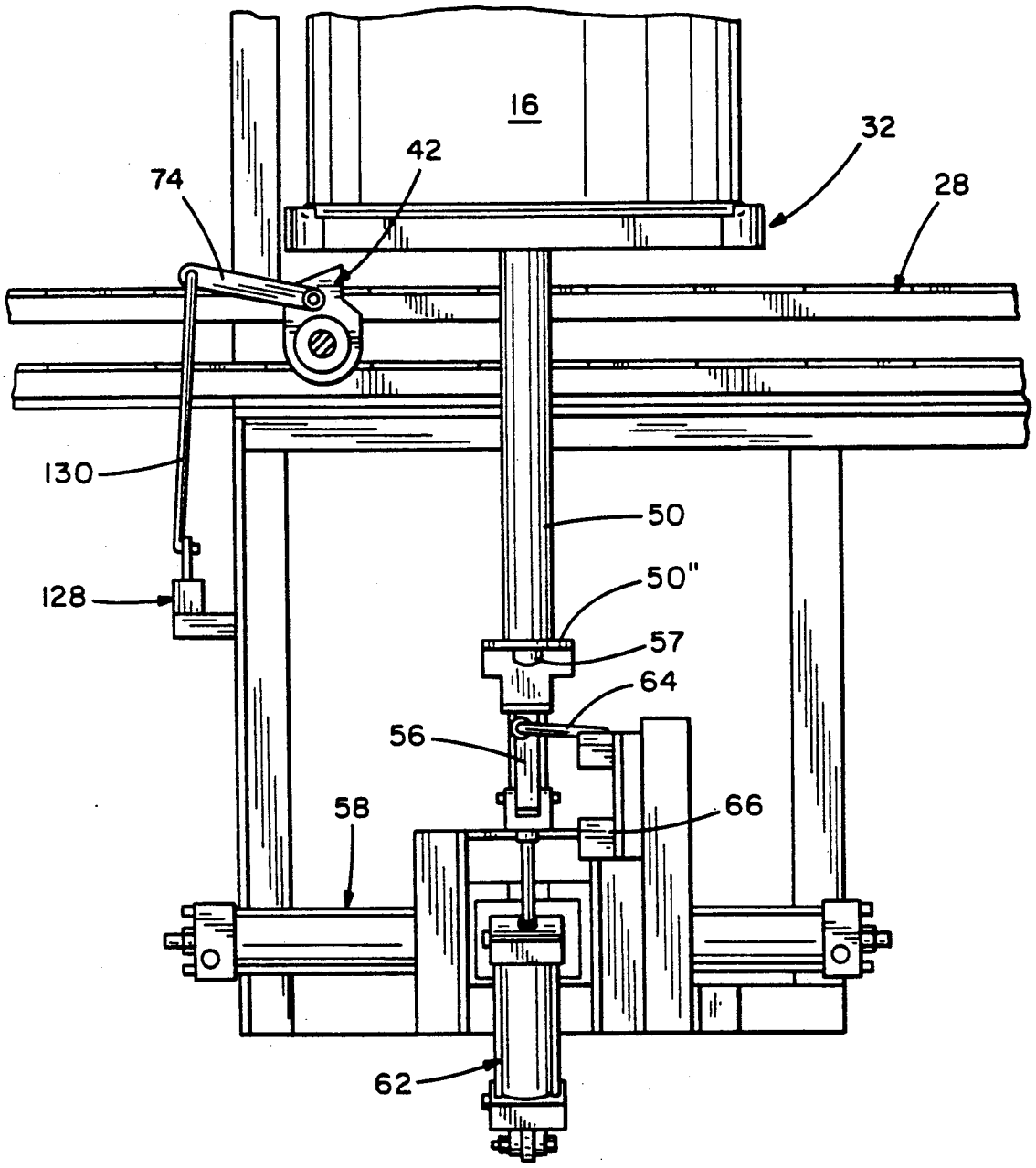
FIG. 7 is a side elevational view similar that of FIGS. 3 and 6, but showing the oven-apparatus in its third stage of operation, where the front stops have been retracted to their lowered positions, and with the drum-lifting platform or turntable in its raised, flame-treating position, with rear stops in their raised positions.

Referring to FIGS. 2–4, the forward clamps 40, 42 are mounted for rotation by a pivot shaft 110 supported in journal bearings 112, 114. The pivot shaft 110 is rotatable via a crank-arm 116 mounted at one lateral end of the pivot shaft, as seen in FIGS. 2 and 6. The free end of the crank-arm 116 is pivotally connected to an upper end of a piston rod 118 of the pneumatic cylinder 106. Each of the pair of forward clamps 40, 42 defines a main body portion mounted about the pivot shaft 110, as seen in FIG. 2, and also defines a pawl-like extension 40', 42', respectively, which pawl-like extensions provide the abutment-surfaces for stopping the conveyance of the drum therepast. Connected between these pawl-like extensions is a smaller-diameter pivot post 124 which mounts the actuator arm 74 for rotation, the arm 74 being spring-biassed in the clockwise direction when viewing FIG. 6. The forward end of the arm 74 is associated with a limit-switch 128 via a downwardly-extending contact arm 130, such that, when the arm 74 is rotated in the counterclockwise direction by an impinging drum, the limit-switch 128 causes the cylinder 106 to be actuated to rotate the shaft 110 in the counterclockwise direction when viewing FIG. 6, so as to retract the forward clamps 40, 42, to allow for the passage therepast of a drum after the drum has been lifted, rotated, flame-treated and lowered by the turntable. Also, as mentioned previously, the cylinder 106 is actuated to rotate the shaft 110 in the, opposite, clockwise direction upon the tripping of the actuator arm 100 by the new, next-in-line and advancing drum.

While a specific embodiment of the invention has been, it is to be understood that numerous changes and modifications may be made therein without departing from the scope, spirit and intent of the invention as set forth in the appended claims.

What we claim is:

1. A process for koshering metallic food storage containers, said containers manufactured from flat sheet steel on whose interior surface oils, greases, and dirt are suspected of being present, said process comprising the steps of:

a) removing oils, grease and other contaminants entrained within the pores of and on said interior surface by conveying each container via a conveyer through an oven-apparatus having a first flame-burner for providing flames for entering into said interior surface of the container, and a second flame-burner for providing flames for contact against the outer circumferential surface of the container;

b) said step (a) comprising conveying a container to close proximity to the first and second flame-burners;

c) lifting the container above the conveyer and rotating the container; and d) igniting the first and second flame-burners, so that as the container rotates, both the interior and exterior surfaces of the container are flame-treated by the flames from the first and second flame-burners.

2. The process according to claim 1, wherein said step of conveying comprises supporting the container on a pair of parallel, spaced-apart, continuously-running conveying elements.

3. The process according to claim 2, wherein said step of rotating comprises rotating the container one complete rotation of approximately 360 degrees.

4. The process according to claim 1, wherein said step (d) comprises operating said flame-burners for a predetermined period of time for burning off any contaminants from the surfaces of the container and shutting off said burners after said predetermined period of time; said step (a) further comprising:

e) lowering the container after said step of shutting off said burners; and f) returning the container onto the conveyer for conveyance out of the oven.

5. The process according to claim 4, wherein said step (d) comprises actuating an actuator by the container as said container is conveyed during said step (b), said step of actuating causing the firing of said flame-burners after a predetermined time-delay, said time delay being at least long enough to allow the lifting of the container during said step (c).

6. The process according to claim 5, wherein said step (b) also comprises activating forwardly-positioned clamping means into an erect state thereof by the container as said container is conveyed, for stopping further movement therepast, and stopping the container via the clamping means approximately adjacent the flame-burners for the subsequent performance of said (c).

7. The process according to claim 6, wherein said step (c) comprises supporting the container on a vertically-reciprocative turntable after said step of stopping the container via the clamping means.

8. The process according to claim 7, further comprising lowering the clamping means before said step (f), so that the flame-treated container may pass therepast.

9. The process according to claim 1, repeating said steps (b) through (d) a number of times for a number of containers in order to flame-treat a series of containers one after the other.

10. The process according to claim 9, comprising further comprising preventing movement of the container that is to be flame-treated next via stopping means positioned upstream of the flame-burners while a downstream container being flame-treated is undergoing said steps (b) through (d), and allowing movement of the container that is to be flame-treated next past the stopping means after the downstream container has had said step (d) performed thereon.

11. The process according to claim 10, wherein said step (d) comprises operating said flame-burners for a predetermined period of time for burning off any contaminants from the surfaces of the container and shutting off said burners after said predetermined period of time; said step (a) further comprising:

e) lowering the container after said step of shutting off said burners; and f) returning the container onto the conveyer for conveyance out of the oven-apparatus.

12. The process according to claim 11, wherein said step of allowing movement is carried out after said step (f).

13. The process according to claim 12, wherein step of preventing comprises raising the stopping means in response to the movement of a downstream container to be flame-treated during the portion of travel thereof performed by said (b) between the upstream position of the stopping means and the downstream position of the flame-burners.

14. The process according to claim 9, wherein each said step (c) comprises rotating the container in a direction opposite to the direction of rotation of at least one of the previous flame-treated container and next container to be flame-treated.

15. An oven-apparatus for flaming the interior and exterior surfaces of a container for removing nonkosher oils, fats, dirt, and the like, comprising:

a main housing having a main section defining a tunnel through which are conveyed containers to be flame-treated;

a first flame-burner mounted in said main section capable of developing a substantially vertically-oriented exposed flame for flame-treating the interior surface of a container;

a second flame-burner mounted in said main section capable of developing a substantially horizontally-oriented flame for flame-treating the exterior surface of a container;

conveyor means for conveying a plurality of containers to be flame-treated adjacent to said first and second flame-burners, such that the hollow interior of each container is exposed to the flame of said first flame-burner and said exterior surface of each container is exposed to the flame of said second flame-burner;

said conveyor means passing through said tunnel for conveying the containers into and out of said main section; and container-support means mounted in said main housing for lifting and rotating a container conveyed thereto via said conveyer means.

16. The apparatus according to claim 15, wherein said first flame-burner is mounted below said conveyer means so that the flame thereof projects upwardly beyond said conveyer means.

17. The oven-apparatus according to claim 16, wherein said conveyor means comprises a pair of spaced-apart conveyors, each conveyor supporting each container on a lower rim portion of the container;

said pair of conveyors being spaced apart such that the flames of said first flame-burner project upwardly therebetween and into the hollow interior of each container positioned over said flame-burner.

18. The apparatus according to claim 17, wherein said second flame-burner has a height so as to provide flames extending the entire height of the container to be flamed, so that the entire outer circumferential surface of each container may be exposed to the flames thereof.

19. The apparatus according to claim 17, wherein said container-support means comprises a vertically-reciprocative turntable, means for moving said turntable in the vertical direction between a raised state thereof and a lowered state thereof, means for rotating said turntable in said raised state thereof, and means for actuating said means for moving and said means for rotating at the specific times.

20. The apparatus according to claim 19, wherein said turntable is mounted for vertical movement between said pair of spaced-apart conveyers, said lowered state thereof being below said pair of conveyers, and said raised state thereof being above said pair of conveyers.

21. The apparatus according to claim 20, wherein said conveyer means further comprises retractable forward stop means for stopping a container adjacent said first and second flame-burners in order to position a container over said turntable; said stop means being movable between a first raised position between said pair of conveyers and projecting upwardly therebeyond to stop a container, and a second lowered position below said pair of conveyers to allow passage therepast; said stop means comprising at least one movable stop member, means for mounting said at least one stop member for movement between said first and second positions thereof, and means for moving said stop means between said first and second positions thereof.

22. The apparatus according to claim 21, wherein said conveyer means comprises switch means for controlling said means for moving said stop means, said switch means comprising a first actuator along a downstream portion of said conveyer means for actuating said means for moving to position said stop means in said first raised position thereof, said first actuator being contacted by a container being conveyed by said conveyer means; and a second actuator located in close juxtaposition to said flame-burners and said stop means proper for contact by a container positioned over said turntable for causing said means for moving to position said stop means in its second retracted position.

23. The apparatus according to claim 22, wherein said second actuator is also operatively coupled to said means for moving said turntable in the vertical direction for actuating said means for moving said turntable in the vertical direction in order to lift a container off of said conveyer means when a container is positioned thereabove.

24. The apparatus according to claim 23, wherein said switch means further comprises third actuator means for sensing the complete rotation of said turntable, said third actuator means being coupled to said means for rotating said turntable and to said means for moving said turntable in the vertical direction, whereby said third actuator means causes said means for rotating said turntable to stop rotation and to actuate said means for moving said turntable in the vertical direction to lower said turntable to said lowered state thereof.

25. The apparatus according to claim 24, further comprising retractable rear stop means for preventing further movement of a container along said conveyer means until a previous container has been lowered back onto said conveyer means by said turntable; said rear stop means being movable between a raised state and a lowered state; said first actuator means being coupled to said rear stop means to also cause said rear stop to be positioned in its raised state.

26. The apparatus according to claim 25, wherein said switch means further comprises fourth actuator means coupled with said rear stop means for causing said rear stop means to be positioned in said lowered state thereof, said fourth actuator means being mounted downstream of said turntable and being contacted by a container moving therepast after having been lowered back onto said conveyer means.

27. The apparatus according to claim 16, wherein said conveyer means comprises activating means for causing the ignition of said first and second flame-burners in response to the passage therepast of a container, said activating means being positioned downstream of said first and second flame-burners so that a container contacts said activating means before reaching said container-support means.

28. The apparatus according to claim 15, wherein said first and second burners are in close proximity to each other; said first flame-burner being located below said container-support means, and said second flame-burner being located laterally adjacent to said container-support means, whereby the flaming of the interior and exterior surfaces of a container is carried substantially simultaneously.

* * * * *